United States Patent [19]

Bechtold et al.

[11] Patent Number: 4,762,160

[45] Date of Patent: Aug. 9, 1988

[54] SKYLIGHT SHADE ASSEMBLY

[76] Inventors: Stephen K. Bechtold, 306 Ocean Ave., Northport, N.Y. 11768; Alec W. Bechtold, 54 N. Bayles Ave., Port Washington, N.Y. 11050

[21] Appl. No.: 899,015

[22] Filed: Aug. 22, 1986

[51] Int. Cl.[4] ..... A47H 1/00

[52] U.S. Cl. ..... 160/98; 24/136 A; 52/200; 160/265

[58] Field of Search ..... 52/72, 200, 202; 24/136 A; 160/32, 33, 84 R, 98, 178 C, 265; 49/62, 63

[56] References Cited

U.S. PATENT DOCUMENTS

| | | | |
|---|---|---|---|
| 792,902 | 6/1905 | Kelly | 98/42.16 |
| 1,276,365 | 8/1918 | Hopkins | 24/132 R |
| 1,888,522 | 11/1932 | Ward | 49/86 |
| 1,964,205 | 6/1934 | Johnson | 160/265 |
| 2,780,283 | 2/1957 | Wasserman | 160/26 |
| 2,875,710 | 3/1959 | Bechtold | 52/72 |
| 3,090,613 | 5/1963 | Bechtold | 49/325 |
| 3,280,893 | 10/1966 | Webb et al. | 160/281 |
| 3,931,846 | 1/1976 | Zilver | 160/178 C |
| 4,352,386 | 10/1982 | Butler et al. | 160/178 C |
| 4,408,422 | 10/1983 | Bechtold | 52/72 |
| 4,441,284 | 4/1984 | Bechtold | 52/72 |
| 4,594,821 | 6/1986 | Bechtold et al. | 52/72 |
| 4,610,116 | 9/1986 | Schulz | 52/204 |

FOREIGN PATENT DOCUMENTS

| | | | |
|---|---|---|---|
| 384302 | 4/1908 | France | 24/136 A |
| 17793 | of 1893 | United Kingdom | 160/178 C |
| 23877 | of 1905 | United Kingdom | 24/136 A |
| 445356 | 4/1936 | United Kingdom | 160/265 |

*Primary Examiner*—John E. Murtagh
*Assistant Examiner*—Andrew Joseph Rudy
*Attorney, Agent, or Firm*—Hoffmann & Baron

[57] ABSTRACT

A shade assembly for a skylight of the type adapted to be mounted in an opening in a roof structure and including a supporting base mounted in the opening in the roof structure and a dome assembly positioned in the supporting base to overlie the opening. The shade assembly includes a support bracket adapted to be affixed to the skylight and a shade support having a shade rolled thereabout. The shade support is rotatably mounted on the support bracket in a manner that permits the shade support to rotate so that the shade can be rolled and unrolled. A shade actuator is attached to the shade and is adapted to be grasped and activated to actuate rolling and unrolling of the shade. Guide surfaces are mountable on the skylight in position to engage and guide the actuator out of alignment with the visual passageway through the opening in the roof and the skylight while facilitating the uniform rolling and unrolling of the shade. An anchor cleat is provided to retain the shade in the unrolled condition, store the shade cord, and provide a safety catch to prevent the shade from re-rolling too fast.

12 Claims, 4 Drawing Sheets

SKYLIGHT SHADE ASSEMBLY

BACKGROUND OF THE INVENTION

A multiplicity of different types of skylights have been developed over the years. Basically they are designed for providing access of light and air through a roof structure. They are mounted within an opening in a building structure such as a roof in a variety of different ways. The overall objective of the mounting operation is to maintain a sealed interengagement to prevent leakage while permitting an unobstructed passageway for vision and light.

Various designs include means for opening and closing the skylight to provide ventilation capability as well as an access means for the passage of light. The skylight dome structure through which the light passes is formed of a transparent or translucent material. Certain plastic such as acrylics, and glass materials are commonly used for this purpose.

Of course, with use of materials designed to permit the passage of sunlight therethrough, there is often concern over the amount of heat introduced by the sunlight into the interior of the building. Also, at times it is necessary to reduce the amount of light passing through the skylight. This concern of the amount of heat and light permitted to pass through the skylight is normally not controllable by the skylight structure alone. The intensity of the heat and light to which the skylight is subjected is also variable and depends on natural conditions such as the angle of the sun with respect to the skylight and whether or not it is a partly cloudy or cloudy day.

Accordingly, there is clearly a need for improved ways in which to control the amount of heat and light passing through the skylight and into the enclosure covered by the roof structure.

Also, it is sometimes advantageous to partially or fully obscure the visual passageway through the skylight, such as for security or privacy purposes for example.

Examples of patents showing skylight structures in which improvement is desirable in order to further control the amount of heat and light passing within the structure or the size of the visual passageway therethrough include U.S. Pat. Nos. 2,875,710, 3,090,613, 4,408,422, 4,441,284 and 4,594,821. These patents show the sequence of developments in recent years in regard to skylight design and show structures which are readily adaptable to the concept of the present invention and therefore, the content of each of these patents is incorporated herein by reference.

It should also be kept in mind that in providing a structure for controlling the visual passageway through a skylight, that structure should have certain features. It should be concealed wherever possible so that the aesthetic appearance of the skylight assembly and the visual passageway is not unduly detracted from. It should also be mounted on the interior wherever possible to provide advantages in manufacture, installation and maintenance. Furthermore, in those embodiments where an actuator mechanism is employed for shifting the structure to partially or completely obscure the skylight opening, and the actuator includes a cord, it is desirable to provide a means for affixing a cord to maintain the structure in position, to prevent accidental slippage of the cord, and to prevent the cord from shifting too quickly which could cause damage or at least distracting movement of the structure with respect to the skylight.

SUMMARY OF THE INVENTION

Thus, with the above background in mind, it is among the primary objectives of the present invention to provide an improved apparatus for controlling the amount of light and heat received from sunlight or another exterior light source through a skylight and for permitting the selective limiting of the size of the visual passageway through the skylight.

A further objective is to provide a skylight shade assembly which is readily mountable in a variety of different types of well-known skylights. For example, it is applicable to a glass or a plastic skylight whether fixed and permanently closed or capable of being opened either by manual or motorized means.

A further objective of the present invention is to provide a low cost skylight shade assembly that is economic to manufacture, install and maintain. The assembly is easily operable to position a shade within a skylight structure so that it can be adjusted to completely uncover or cover a portion or all of the opening in alignment with the skylight dome through which light and heat pass and which forms the visual passageway.

Still a further objective of the present invention is to provide a skylight shade assembly including actuating means maintained out of alignment with the passageway through the opening in the roof and through the skylight dome and yet which is in a operable position to uniformly roll and unroll a shade across a portion of or the entire passageway through the skylight.

Still a further objective of the present invention is to provide a skylight shade assembly which includes a shade on a shade support or roller mounted on a bracket. A biased spring on the support and bracket maintains the shade in the rolled condition. The shade is capable of being unrolled by an actuator mechanism which is activated by the grasping and pulling of a cord. Release of the cord permits the shade to automatically re-roll. The shade is adapted to unroll along a predetermined path as determined by a shade molding around the periphery of the skylight support structure. The shade is directed by the cord passing over a series of pulleys mounted at the periphery of the skylight structure so that the cord is maintained out of alignment with the passageway through the skylight during both use and non-use periods of time.

A further objective of the invention is to provide a series of guide moldings and pulleys and a cord is guided by the pulleys and moldings and has its free ends attached to the peripheral edges of the shade respectively. The cord elements extending from the free ends are directed into adjacent position at the center portion of the cord so that they can be simultaneously grasped and pulled to uniformly draw the shade across the skylight passageway without having the cord elements interfering with the access opening or passageway through the skylight. When the cord elements are released the shade is re-rolled onto a support which is spring mounted to a supporting bracket along one wall of the skylight supporting structure.

It is still a further objective of the present invention to provide an anchor means for affixing the cord elements which have been grasped and pulled to draw the shade into overlying relationship with respect to the access opening or passageway through the skylight in order to maintain the position of the cord and shade relative to the skylight.

A further objective is to provide an anchor means which is in the form of a cleat adapted to be mounted to the structure adjacent to the shade assembly in position to affix the cord elements thereto. The cleat includes a reduced diameter portion and a through passageway so that the cord elements can be extended through the through passageway and be wrapped around the reduced diameter portion and tied in position. The reduced diameter portion forms surfaces to store the excess cord of the cord elements.

Affixation is facilitated by providing a tapered surface to the passageway through the anchor cleat and housing a floating roller in the tapered passageway which is permitted to float between both ends of the passageway. When the cleat is adjacent to the narrow diameter end of the passageway it will wedge the cord elements against the inner surface of the cleat and, when the roller is displaced toward the wider diameter portion of the passageway, there is sufficient space to permit the cord to freely pass between the roller and the adjacent surface of the passageway. The roller and passageway are designed to provide a safety catch means for the assembly. The roller, passageway and cord elements are dimensioned so that if the cord travels through the passageway below a predetermined rate of speed, its movement will not be restricted, however, if the cord reaches a predetermined rate of speed in its travel through the passageway, the roller will wedge the cord in position against the wall of the passageway and prevent further movement. Accordingly, this provides a safety catch against too rapid movement of the shade assembly when it is being re-rolled or when the cord has been accidentally inadvertently released.

It is a further objective to provide an anchor means in the form of a cleat which can be readily and easily mounted to the skylight structure in position to have the actuating means in the form of a cord or cord elements removably attached thereto in a position which is removed from the principal area of passageway for light, heat and visual access through the skylight structure.

A further objective of the present invention is to provide a shade assembly which is formed entirely of non-corrosive materials which is extremely advantageous in use with skylight assemblies that are conventionally exposed to all types of weather conditions.

A further objective is to provide a shade assembly which, when mounted in connection with a skylight installation, is substantially entirely concealed. This provides the advantage of being able to partially or fully obscure the passageway through the skylight but does not attract from the overall visual appearance of the skylight installation due to the presence of the shade assembly. The shade assembly is mounted in an unobtrusive manner and, furthermore, is designed to be mounted interiorly of the skylight installation so as to again avoid unsightly appearances and also to reduce wear and tear and add to the longevity of the shade assembly.

In summary, a shade assembly for a skylight is provided. The skylight is the type adapted to be mounted in an opening in a structure and to include a supporting base mounted in the opening in the structure and a dome assembly positioned on the supporting base to overlie the opening. The shade assembly includes a support bracket adapted to be affixed to the skylight and a shade support having a shade rolled thereabout. Mating attachment means is on the bracket and the shade support to permit rotatable mounting of the shade support on said bracket so that the support can rotate to permit the rolling and unrolling of the shade with respect to the bracket. Shade actuation means is attached to the shade and is adapted to be grasped and activated to actuate rolling and unrolling of the shade. Guide means is adapted to be mounted on the skylight in position to engage and guide the actuation means out of alignment with the passageway through the opening in the skylight while facilitating the uniform unrolling and rolling of the shade.

It is also contemplated that the skylight shade assembly include an anchor means to retain the actuation means and the shade in the unrolled condition with the shade covering the passageway through the skylight and to facilitate holding of the actuation means in a non-interfering position when the shade is in the rolled condition.

With the above objectives among others in mind, reference is made to the attached drawings.

DETAILED DESCRIPTION OF THE DRAWINGS

Figure 1:
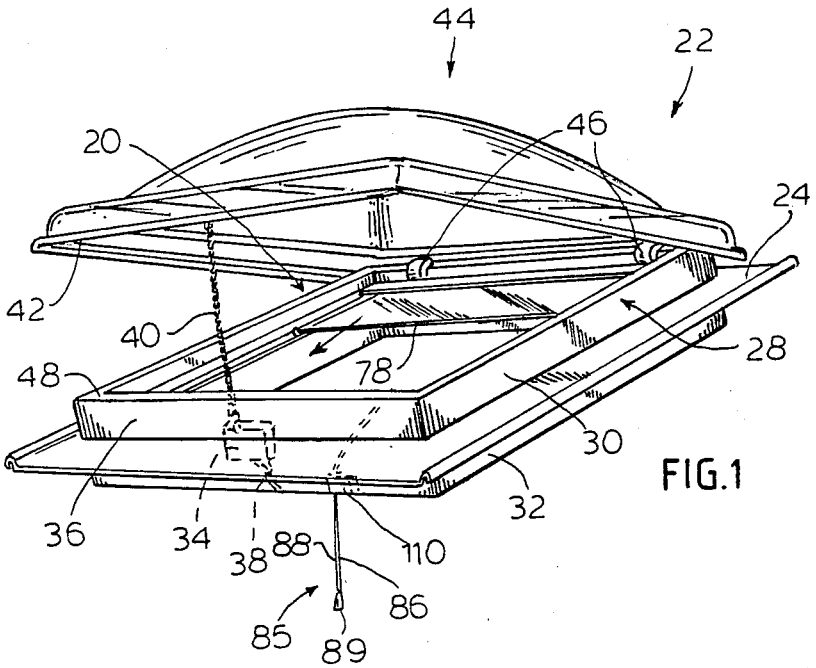
FIG. 1 is a perspective view of the shade assembly of the invention mounted on a skylight.
Figure 2:
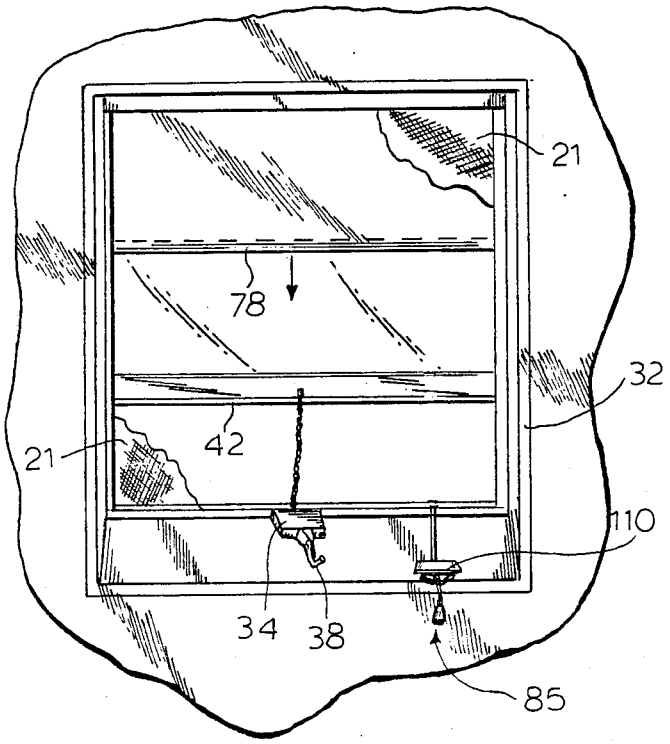
FIG. 2 is a bottom view thereof.
Figure 4:
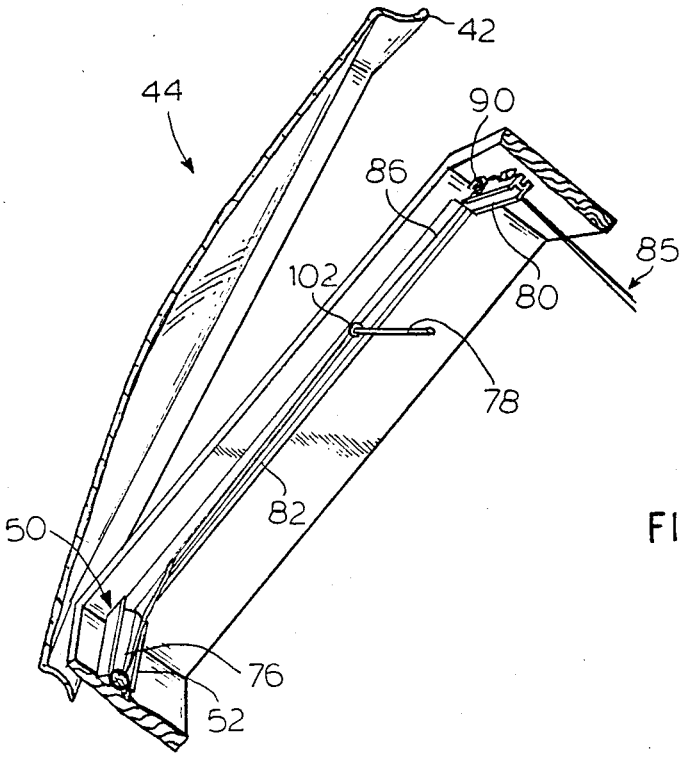
FIG. 4 is a sectional view of the embodiment of FIG. 1.

FIGS. 1, 2 and 4 show the shade assembly, 20 mounted on a skylight 22. The shade assembly 20 is adapted to be mounted on many different types of commercially available skylights, and in the drawings and it is shown in connection with a skylight of a type manufactured and sold by Ventarama Skylight Corporation of Hicksville, N.Y. Skylight 22 includes appropriate flashing such as copper flashing 24 to surround an opening in a roof structure. A roof structure 26 is depicted in FIG. 2. The flashing rests on the roof and surrounds the peripheral outer surface of a rectangularly shaped liner 28. Conventionally, liner 28 is formed of wood but alternatively it may be formed of a metal or plastic material. Liner 28 extends through the opening in the roof structure 26 and surrounds the peripheral edge of the opening with an upper portion 30 extending above the roof 26 and a lower portion 32 extending below the roof into the interior of the structure.

Depicted skylight 22 is of the type which is designed to open for ventilation and has an operating mechanism mounted on one end wall 36 of the liner 28. The operating mechanism is mounted on the interior side of the end wall 36 and include a handle 38 for manually operating the mechanism. Reciprocally moveable into and out of the operator 34 is an operator chain 40 which has its free end affixed to the free edge 42 of a dome assembly 44. The dome assembly 44 includes an inner dome and an outer dome which are substantially aligned across their surfaces and slightly spaced from one another in the dome area for insulation purposes. The opposite side of the dome assembly from that attached to the operator is mounted to the liner by appropriate hinge structure 46. Other than attachment by means of the hinge structure 46 and the operator chain 40, the dome is free to open and close with respect to the liner. A sealing gasket surrounds the peripheral edge of the dome structure 44 to sealingly engage with the upper peripheral wall 48 of the liner when the skylight is closed.

Shade assembly 20 is mounted on the inner surface of the liner 28 intermediate the exposed edges of the upper and lower portions 30 and 32.

Optionally, a conventional screen 21 is mounted internally of the shade assembly on suitable conventional screen support brackets and clips. In this manner, the shade assembly is positioned between the screen and the skylight dome assembly 44. The shade assembly is formed of non-corrosive materials to resist deterioration due to natural weather conditions. It is also mounted on the interior of the skylight structure for protective and aesthetic reasons.

Figure 3:
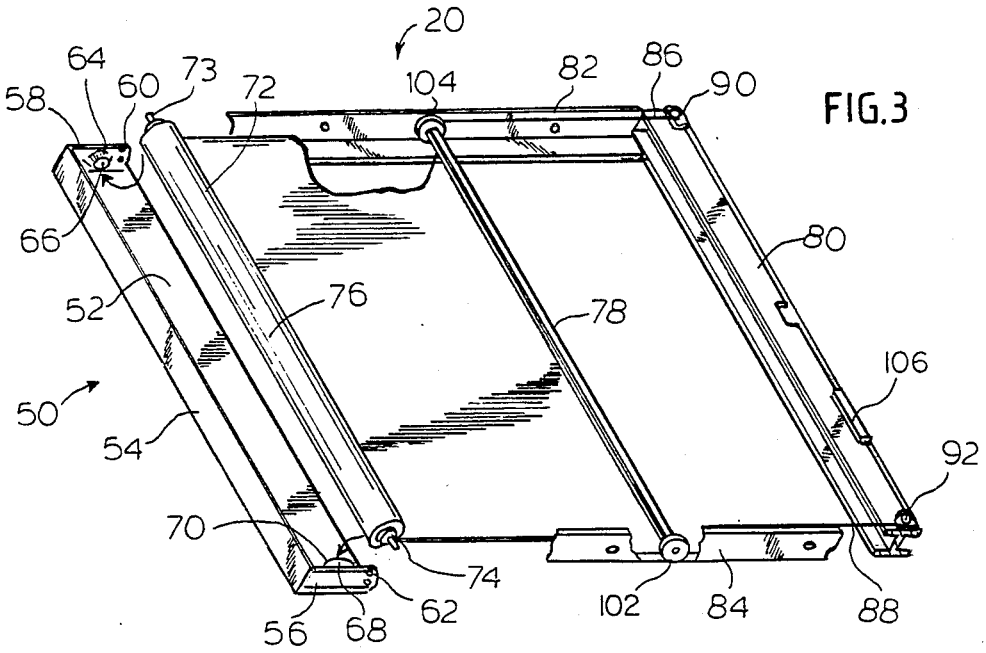
FIG. 3 is a partially exploded perspective view of the shade assembly of the invention.

The elements of shade assembly 20 are apparent in FIG. 3. A support bracket or valance 50 is located at one end of the shade assembly and, as shown, is generally rectangular in configuration. The support bracket includes a base wall 52 a rear wall 54 and two end walls 56 and 58. One end wall includes a pair of slots 60 for the introduction of mounting fasteners to engage the inner surface of liner 28. Similarly, the other end wall 56 has a pair of slots 62 for the introduction of mounting fasteners to engage the inner surface of liner 28. In this manner, the bracket can be mounted to the liner by the use of conventional fasteners.

End wall 58 includes a raised portion 64 on its inner surface with a central aperture 66 therein. Similarly, opposing end wall 56 has a raised portion 68 with appropriate conventional apertures and slots 70 used in commercially available roll shade brackets. Support bracket 50 is mounted to the side of liner 28 on which the hinged side of the dome assembly 44 is mounted. However, it could just as well be mounted on any of the three remaining sides of the liner.

The bracket 50 is designed to receive a shade support 72. The shade support is in the form of a cylindrical roll having a spring member 74 projecting from one end and a pin projecting from the other. Pin 73 is designed to be received in aperture 66 of end wall 58 and spring projection 74 is adapted to be received in the appropriate apertures in projection 68 of end wall 56. This mounting is a conventional type of shade roll and support bracket mounting available commercially for window shades.

Rolled about cylinder 72 is the skylight shade 76 which is formed of commonly used shade material such as Sun Screen solar screening manufactured by Phifer Wire Products of Tuscaloosa, Ala. The shade 76 is stapled or otherwise conventionally attached to the surface of cylinder 72 at its one transverse edge. The other transverse free edge 78 is in position to be grasped and pulled thereby unrolling the shade from the support 72. The spring arrangement between the shade support 72 and the support bracket 50 tends to return the shade to its rolled condition and withdrawing free end 78 from the roll biases the spring.

Figure 5:
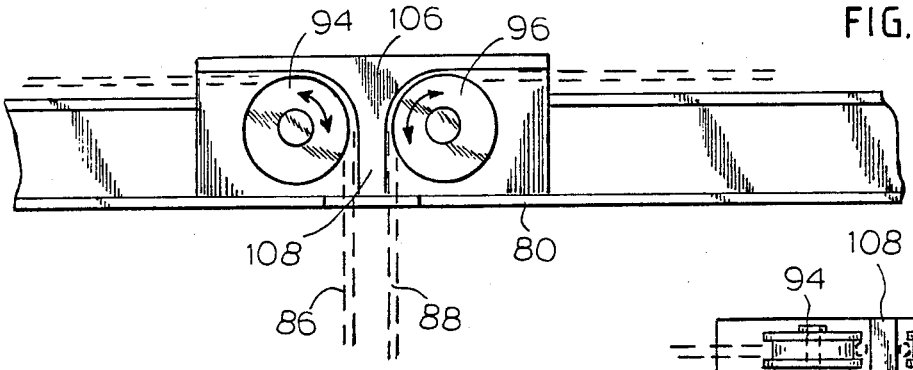
FIG. 5 is a fragmentary elevational view of a portion of the molding and pulley arrangement for the shade assembly of the invention.
Figure 6:
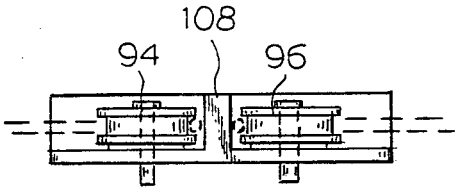
FIG. 6 is a bottom view of the portion of the invention depicted in FIG. 5.
Figure 7:
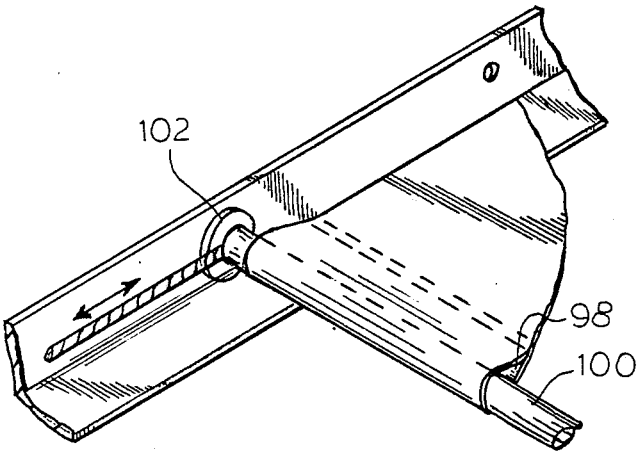
FIG. 7 is a fragmentary view of the shade assembly of the invention showing the attachment of the cord element to a side of the free end of the shade and adjacent molding.

The remaining elements of the shade assembly include a guideway arrangement formed of peripheral moldings including an end molding 80 and two opposing side moldings 82 and 84 which are disposed on a supporting base which includes the liner 28. Each of the free ends of a cord 85 are attached to opposing peripheral edges of the shade and the resulting cord elements 86 and 88 are then extended about separated base pulleys 90 and 92 on end molding 80. The cord elements 86 and 88 are then directed to adjacent base pulleys 94 and 96 (depicted in FIG. 5) and then extend downwardly from pulleys 94 and 96 adjacent to one another and terminate in a cord drop 89 for grasping by the user.

The free end 78 of shade 76 has a hollow transverse recess 98 formed therein through which extends a rigid end bar 100. The opposing transverse ends of end bar 100 include enlarged knobs 102 and 104 which are adapted for travel along the channel shaped side moldings 84 and 82 respectively. Cord elements 86 and 88 are attached adjacent to knobs 102 and 104 so that the shade is drawn across the opening passageway of the skylight by attachment to its peripheral sides. In this manner, the cord elements 86 and 84 are not positioned over the passageway through the skylight but travel through the side moldings 82 and 84 and then transversely through the end molding 80 to extend over end pulleys 94 and 96 and downward to be grasped by the operator.

Moldings 82, 84 and 80 along with support bracket 50 and shade support 72 can be formed of conventional non-corrosive metal, wood or plastic materials. The same is true of pulleys 90, 92, 94, and 96. The guide arrangement formed by the channeled side moldings 82 and 84 and the channeled end molding 80 along with the pulleys 90, 92, 94 and 96 allow for the cord elements 86 and 88 to be drawn along the peripheral edges of the shade assembly and, thus, the elements do not interfere with the passageway through the skylight when the shade assembly is mounted around the peripheral inner sides of the liner of the skylight. Additionally, the same arrangement of channels and pulleys permits the shade to be drawn uniformly across its width as it is extended into overlying relationship with the opening through the skylight assembly.

The shade is unrolled in a manner such that it can be drawn across a portion or all of the opening through the skylight depending upon the desired and predetermined amount of shading required to reduce the size of the visual passageway and the amount of light and heat coming through the skylight from the exterior of the building.

Figure 8:
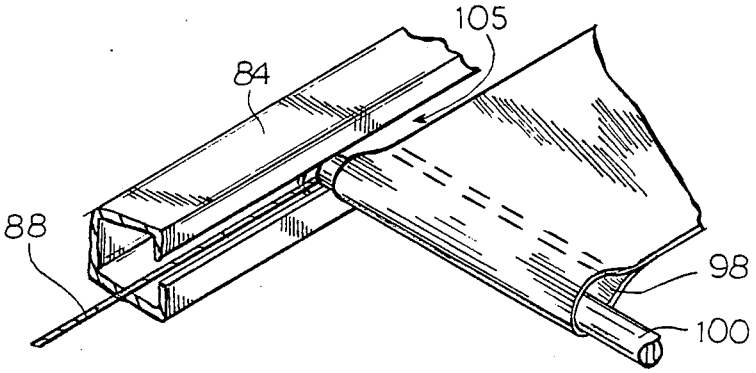
FIG. 8 is a fragmentary view of the shade assembly of the invention showing attachment of the cord to the shade and a portion of the molding through which the cord travels.
Figure 9:
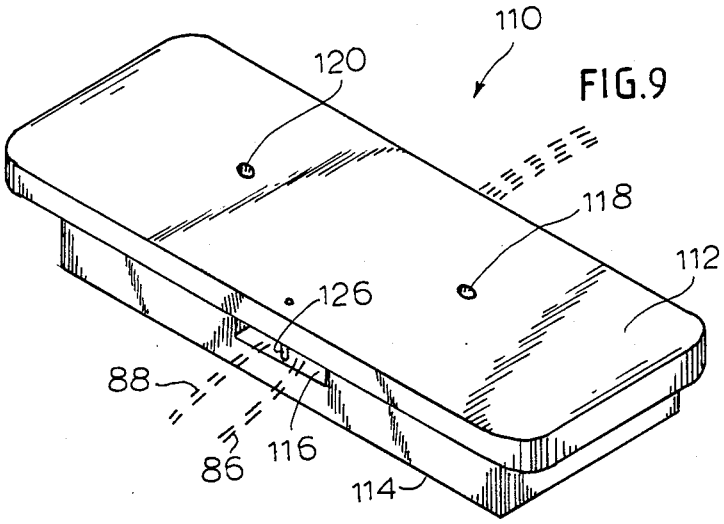
FIG. 9 is a perspective view of the anchor cleat for use with the shade assembly of the invention and, in phantom, showing cord elements passing therethrough.
Figure 10:
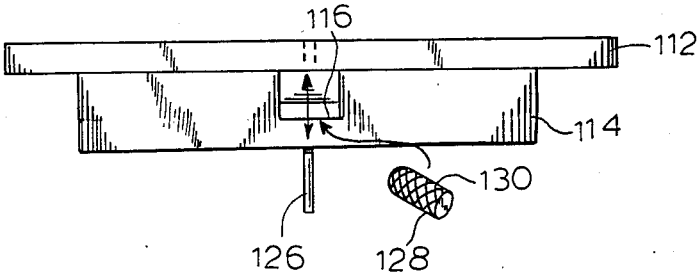
FIG. 10 is a exploded view thereof.
Figure 11:
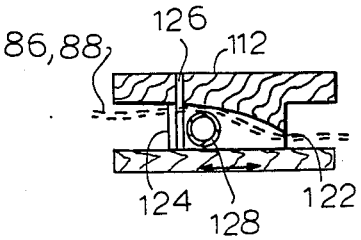
FIG. 11 is a sectional end view thereof showing the position where the cord is free to move therethrough and arrows showing directions of movement.

Ease and efficiency of movement of the shade both in the rolling and unrolling direction is facilitated by the channels in the side moldings which are dimensioned to be somewhat larger than the end projections 102 and 104 so that the end bar is permitted a limited amount of lateral play to facilitate ease of movement. Similarly, the channel opening 105 through which the end bar extends can be slightly larger than the end bar but still smaller than the diameter of the knobs 102 and 104. In this manner, freedom of movement is facilitated thereby adding to the efficiency of operation of the shade assembly. This capability of relative movement is depicted in FIG. 8 where access opening 105 in side molding 84 is slightly larger than end bar 100 but smaller in diameter than knob 102. It will be also noted in FIG. 8 that cord element 88 travels within side molding 84 and thus is not located in the passageway through the skylight assembly.

Pulleys 94 and 96 which are in adjacent relationship with one another in the end molding 82 are located in a common pulley housing 106. The pulley housing 106 has a center wall 108 spacing the two pulleys 94 and 96 which are rotatably mounted on housing 106 which in turn is affixed to end molding 80. Attachment of all of the pulleys in the structure is accomplished by conventional well-known means such as axles journaled in the respective moldings about which the pulleys rotate. The moldings are attached to the inner surface of the liner 28 in a conventional manner such as by screws, rivets or other common fasteners.

Cord elements 88 and 86 can be formed of any common shade pull cord material.

Operator 34 is centrally located to facilitate uniform opening and closing of the skylight and pulley housing 106 is positioned between the operator 34 and the side molding in a location which facilitates uniform rolling and unrolling of the shade. The relative locations can be adjusted as long as the result is no interference therebetween or deleterious effect on the operation of the shade assembly and the skylight.

With the exception of the depending cord elements 86, 88, the remainder of the cords, pulleys, shade and shade roll are concealed from view when looking upward through the skylight. Thus, the slide assembly is largely unobtrusive except when the shade is unrolled.

An appropriate anchor means is provided on the exterior surface of liner 28 for attaching the shade cord elements 86 and 88 whether the shade is in the unrolled, partially unrolled or fully rolled condition. As shown in FIG. 1, anchor cleat 110 is affixed to the inner surface of liner 28 on the side wall on which end molding 80 is mounted and from which cord elements 86 and 88 extend.

The details of anchor cleat 110 are depicted in FIGS. 9–12. The cleat is generally rectangularly in configuration and includes an enlarged base 112, and a reduced diameter portion 114 extending from one side of the base. A through passageway 116 extends across the width of the reduced diameter portion 114. Elements 112 and 114 of cleat 110 can be formed of a unitary construction or of two separate pieces affixed in a conventional manner to one another.

The anchor cleat is mounted in a conventional manner to the interior of the liner such as by screws extending through spaced apertures 118 and 120 extending through the anchor cleat 110. Once the anchor cleat 110 has been mounted in this manner to the surface of the liner, exit apertures are provided only at each end of the passageway 116.

The passageway 116 is tapered in configuration along its length so that it has a reduced diameter size at end 122 and a larger diameter size at end 124. A retention post or pin 126 is mounted at the wider open end 124. This serves to capture floating cylindrical roller 128 in passageway 116. The diameter of roller 128 is larger than the size of the opening at end 122 but is smaller than the size of the opening at end 124. Accordingly, post 126 will prevent the roller from escaping through opening 124 and the size of the opening 122 will prevent escape of the roller 122 therethrough at the other end. As shown by the arrow in FIG. 11, roller 128 is free to roll between a position adjacent to wide end 124 of the passageway and a position adjacent to narrower end 122 of the passageway. Roller 128 has a knurled outer surface 130 which facilitates engagement with the cord elements and the surface of the passageway. The roller 128 and the pin 126 can be formed of conventional wood, plastic or non-corrosive metal materials such as brass. The same is true for the remainder of anchor cleat 110.

The reduced diameter portion 114 provides an outer surface which in combination with the under surface of larger base portion 112 forms a storage area for the cord elements to be wrapped around. This is depicted in FIG. 2.

In use, the anchor cleat 110 is affixed to the liner in a position such as shown in FIGS. 1 and 2. This is in proximity and in alignment with cord elements 86 and 88 and cord drop 89. The cord elements 86 and 88 are passed through passageway 116 and are normally free to reciprocally move therethrough in the manner depicted in FIG. 11. The cord drop is below the wider open end 124 of passageway 116 and the narrower opening 122 faces upward toward the rolled shade.

Accordingly, when the shade is to be unrolled, cord elements 86 and 88 are drawn downward through passageway 116 in the direction from narrower opening 122 toward wider opening 124. Movement in this direction frees roller 128 from engagement with the inner wall of the passageway and it floats freely against pin 126. There is sufficient clearance between the outer diameter of the roller 128 and the inner surface of passageway 116 in this position so that the cord elements 86 and 88 can freely move through anchor cleat 110.

When the shade has been unrolled to the desired degree, the cord elements 86 and 88 can be wrapped around the outer surface of reduced portion 114 and tied in that position. In this manner, the shade is fixed in position against the bias of the spring on the shade roll assembly.

Figure 12:
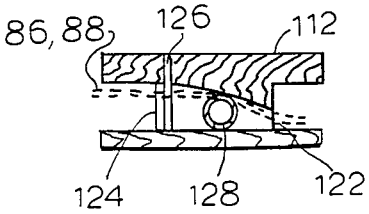
FIG. 12 is a section end view thereof showing the position where the cord is fixed in position.

The dimensions of the roller 128 and the passageway 116 are predetermined so that the roller provides a safety catch against re-rolling of the shade in too rapid a manner. If the shade elements 86 and 88 are released and the shade begins to re-roll too rapidly, the knurled outer surface of roller 128 will engage with the cord elements and will move toward end 122. It will move in this direction until it engages with the wall of tapered passageway 116 and will wedge the cord elements against the wall to retain the cord elements in that position preventing further re-rolling of the shade. This condition is depicted in FIG. 12.

However, gradual movement of cord elements 86 and 88 through passageway 116 in the direction from opening 124 toward opening 122 is permitted. This is due, again, to the dimensional relationship between the thickness of the cords 86 and 88, the diameter of the cylindrical roller 128 and the size of the passageway 116. Slow movement of the cords through the passageway will be permitted as they pass between the outer surface of the roller 28 and the inner surface of the passageway 116 in the area adjacent to pin 126. If the movement becomes too rapid, the roller will again be engaged by the cord and shifted toward open end 122 and wedge the cord elements against the inner surface of the passageway as shown in FIG. 12. A slight agitation of the cord elements 86 and 88 will reshift roller 128 away from the wedge position whereupon slow release of the cord elements 86 and 88 can then be resumed. Accordingly, in this manner the re-rolling of the shade under the bias of the spring in the shade roller will be permitted at a controlled rate.

Additionally, anchor means is provided by use of the anchor cleat 110 to retain the shade in the desired unrolled condition and to provide cord storage means for avoiding the presence of unsightly hanging cord elements.

In summary, the shade assembly including the anchor cleat are formed of inexpensive non-corrosive materials which can be efficiently and economically mounted in well-known types of skylight assemblies and to provide the advantages set forth in detail above.

Thus, the several afore-noted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A shade assembly for a skylight mounted in an opening in a structure forming a visual passageway and which includes a supporting base mounted in the opening in the structure and having a dome assembly positioned on the supporting base to overlie the opening, said skylight shade assembly comprising:

a support bracket adapted to be affixed to said supporting base, the support bracket including a portion thereof extending partially into the visual passageway of the skylight;

a shade support having a shade rolled thereabout, said shade having a fixed end and a free end;

an elongated end bar having opposite axial ends, the end bar being secured to the shade at the free end thereof;

means on said bracket and said shade support to permit rotatable mounting of said shade support on said bracket so that said shade support can rotate to permit the rolling and unrolling of said shade with respect to said bracket, the shade support being mounted on the support bracket and disposed over the portion thereof which extends into the visual passageway so that the shade support and shade rolled thereon are not viewable form below the shade assembly;

a pair of pull cords, each of the pull cords being secured to an axial end of the shade end bar, the pull cords being adapted to be grasped and pulled to actuate rolling and unrolling of said shade; and guide means adapted to be mounted on said supporting base of said skylight for guiding the shade during rolling and unrolling movement thereof, said guide means including:

(a) a pair of parallel, spaced apart side moldings, each side molding being adapted to be mounted on the supporting base, and including a portion thereof extending partially into the visual passageway of the skylight, the axial ends of the end bar being slidably supported by said molding portions, and the pair of pull cords joined to the axial ends of the end bar being disposed over portions thereof above said side molding portions and parallel thereto so as not to be viewable from below the shade assembly;

(b) an end molding, the end molding being adapted to be mounted on the supporting base at a position opposite to the support bracket, the side moldings being interposed between the support bracket and the end molding and defining therewith a frame, the end molding including a portion thereof extending partially into the visual passageway of the skylight, the pair of pull cords being disposed over portions thereof above said end molding portions and extending parallel thereto so as not to be viewable form below the shade assembly;

(c) a first pair of pulleys, each pulley of the first pair being mounted on the end molding over said end molding portion so as not to be viewable from below the shade assembly, the axis of each pulley of the first pair being disposed perpendicularly to the plane in which the shade resides, the pull cords engaging each pulley of the first pair and being partially wrapped thereabout; and (d) a second pair of pulleys, each pulley of the second pair being mounted on the end molding over said end molding portion so as not to be viewable from below the shade assembly, the axis of each pulley of the second pair being disposed perpendicularly to the axis of the pulleys of the first pair, the second pair of pulleys being disposed on the end molding between the pulleys of the first pair, the pulll cords engaging each pulley of the second pair and being partially wrapped thereabout, the end molding having an opening formed therethrough, the pull cords being received by the end molding opening and extending downwardly therefrom for grasping to effect movement of the shade.

2. The invention in accordance with claim 1 wherein the structure is the roof of a building, and the supporting base includes a liner adapted to be mounted adjacent the edge of the opening in the roof structure and around the periphery thereof and forming a wall having a portion extending outward of said roof structure and a portion extending inward of the roof structure, said wall being formed with two opposing pairs of walls, and said support bracket affixed to one wall of said liner and said guide means affixed to the two walls of the other opposing pair of walls.

3. The invention in accordance with claim 1 wherein the dome assembly includes an outer dome and an inner dome spaced from one another and with the outer dome overlying the inner dome, both the domes engaging sealing means positioned on the supporting base.

4. The invention in accordance with claim 3 wherein the inner and outer domes are transparent and are molded with conforming configurations over the portions thereof adjacent to one another.

5. The invention in accordance with claim 1 wherein said support bracket is in the form of an elongated housing having a back wall, a top wall and a pair of opposing end walls and openings at the front and bottom thereof, one end wall having a receiving recess for one end of the shade support and spring means thereon to bias the shade support for the rotation thereof in one direction, the other end wall including a receiving recess for mounting of the other end of the shade support thereby providing for the removable mounting of the shade support on the support bracket, and fastener means to fasten the support bracket to the supporting base.

6. The invention in accordance with claim 5 wherein the shade support is in the form of a cylindrical roller having a protrusion at each end thereof for engagement with the receiving recesses in the respective opposing end walls of the support bracket so as to be rotatable with respect thereto and subjected to the spring bias of the spring means in one of the end walls of the bracket, the shade rolled about the shade support being of flexible shading material with one free end and one end affixed to the shade support, and the shade having sufficient length so that when it is unrolled it covers the substantial portion of the cross section of the passageway through the skylight.

7. The invention in accordance with claim 6 wherein the spring means of the interconnected support bracket and shade support biases the shade into the rolled condition and unrolling of the shade from the shade support being against the bias of the spring.

8. The invention in accordance with claim 1 wherein the skylight includes a screen mounted interiorly of the shade assembly so that the shade assembly is positioned between the dome assembly and the screen.

9. The invention in accordance with claim 1 wherein the shade assembly is formed of non-corrosive materials.

10. A shade assembly as defined by claim 1, which further comprises an anchor cleat, said anchor cleat including:

a body member having a reduced diameter portion and an enlarged base portion joined to said reduced diameter portion to facilitate the winding of the pull cords thereabout and affixation thereto, and said body member further having a cord passageway extending through said reduced diameter portion of said anchor cleat for passage of the pull cords therethrough and subsequent affixation of the pull cords about said reduced body member; and means for mounting said body member to a structure adjacent the visual passageway formed through the skylight and in position to have the pull cords wound about said body member and affixed thereto to prevent movement of the shade assembly with respect to the visual passageway through the skylight.

11. The invention in accordance with claim 10 wherein the pasageway through the anchor cleat is tapered so as to have lesser diameter at one end than the other, a floating roller positioned in the passageway and adapted to float between both ends of the passageway, means to retain the floating roller in the passageway, the roller being positioned so that when the pull cords pass through the passageway and the roller engages the pull cords adjacet the narrower diameter end of the passageway the pull cords will be wedged in fixed position by said roller and when the roller is displaced toward the wider diameter end of the passageway, the pull cords will be free to pass by the roller and travel through the passageway of the anchor cleat.

12. The invention in accordance with claim 10 wherein the roller, tapered passageway and pull cords are dimensioned so that when the pull cords travel through the passageway below a predetermined rate of speed in one direction they will freely bypass the roller and when the pull cords travel through the passageway in the one direction at a greater speed than the predetermined rate of speed, the roller will wedge the pull cords against the narrower diameter portion of the passageway and prevent further passage of the pull cords through the passageway thus providing a safety catch to prevent shade from being shifted across the visual passageway through the skylight at too great a rate of speed.

* * * * *

UNITED STATES PATENT AND TRADEMARK OFFICE

CERTIFICATE OF CORRECTION

PATENT NO. : 4,762,160

DATED : November 18, 1988

INVENTOR(S) : Stephen K. Bechtold

It is certified that error appears in the above-identified patent and that said Letters Patent is hereby corrected as shown below:

Column 9 line 68, after "supported by" insert --side--

Column 10 line 15, change "form" to --from--

Column 10 line 32, change "pulll" to --pull--

Column 12, line 18, change "adjacet" to --adjacent--

Column 12 line 35, after "prevent" insert --the--

Signed and Sealed this

Twenty-fifth Day of April, 1989

*Attest:*

DONALD J. QUIGG

*Attesting Officer*

*Commissioner of Patents and Trademarks*